US005101432A

United States Patent [19]

Webb

[11] Patent Number: 5,101,432

[45] Date of Patent: Mar. 31, 1992

[54] SIGNAL ENCRYPTION

[75] Inventor: Joseph A. Webb, Old West Coast Road R.D. 1, Christchurch, New Zealand

[73] Assignees: Cardinal Encryption Systems Ltd.; Joseph Alfred Webb, both of Christchurch, New Zealand

[21] Appl. No.: 464,891

[22] Filed: Jan. 16, 1990

Related U.S. Application Data

[63] Continuation-in-part of Ser. No. 197,697, May 23, 1988, abandoned, which is a continuation-in-part of Ser. No. 26,691, Mar. 17, 1987, abandoned.

[30] Foreign Application Priority Data

Mar. 17, 1986 [NZ] New Zealand ..... 215498
Jan. 13, 1989 [NZ] New Zealand ..... 227621

[51] Int. Cl.[5] ..... H04K 1/00

[52] U.S. Cl. ..... 380/33; 380/9; 380/50

[58] Field of Search ..... 380/9, 33, 38–40, 380/49, 50

[56] References Cited

U.S. PATENT DOCUMENTS

| | | | |
|---|---|---|---|
| 2,411,683 | 11/1946 | Guanella | 380/36 |
| 2,411,683 | 11/1946 | Guanella | 380/35 |
| 3,337,803 | 8/1967 | Costas et al. | 380/35 |
| 3,662,115 | 5/1972 | Saito et al. | 380/35 |
| 3,970,791 | 7/1976 | Johnson et al. | 380/35 |
| 4,068,094 | 1/1978 | Schmid et al. | 380/35 |
| 4,107,470 | 8/1978 | Maruta | 380/38 |
| 4,160,123 | 7/1979 | Guanella et al. | 380/35 |
| 4,179,657 | 12/1979 | Hobbs | 380/35 |
| 4,184,117 | 1/1970 | Lindner | 380/35 |
| 4,221,431 | 9/1980 | Seiler | 380/35 |
| 4,221,931 | 9/1980 | Seiler | 380/31 |
| 4,247,942 | 1/1987 | Haver | 380/35 |
| 4,340,875 | 7/1982 | English | 333/166 |
| 4,359,736 | 11/1982 | Lewis | 342/16 |
| 4,393,276 | 7/1983 | Steele | 380/38 |
| 4,454,590 | 6/1984 | Belt et al. | 364/750.5 |
| 4,525,844 | 6/1985 | Schuermann | 380/38 |
| 4,575,754 | 3/1986 | Bar-Zohar | 380/35 |
| 4,649,549 | 3/1987 | Halpern et al. | 380/32 |
| 4,649,549 | 3/1987 | Halpern et al. | 380/35 |
| 4,667,298 | 5/1987 | Wedel, Jr. | 364/602 |
| 4,688,251 | 8/1987 | Citron et al. | 380/35 |
| 4,726,064 | 2/1988 | Kishi et al. | 380/38 |
| 4,799,257 | 1/1989 | Kish et al. | 380/38 |
| 4,809,274 | 2/1989 | Walker et al. | 380/28 |
| 4,827,507 | 5/1989 | Marry et al. | 380/38 |

OTHER PUBLICATIONS

Article: "Optimizing Non-Recursive Digital Filters to Non-Linear Phase Characteristics", by L. G. Cuthbert, *The Radio and Electronic Engineer*, vol. 44, No. 12 (Dec. 1974).

Article: "Design of Finite Impulse Response Digital Filters with Nonlinear Phase Response", by Goldberg et al., *IEEE Transactions on Acoustics, Speech, and Signal Processing*, vol. 29, No. 5 (Oct. 1981).

Article: "Iterative Technique for Designing Nonrecursive Digital Filter Non-Linear Phase Characteristics", by Holt et al., *The Radio and Electronic Engineer*, vol. 46, No. 12 (Dec. 1976).

Articles: "Commercial Encryption", by Hellman; Public Key Management for Network Security, by Newman, Jr. et al.; Electronic Document Authentication, by Jueneman; Network Security: Protocol Reference Model and the Trusted Computer System Evaluation Criteria, by Abrams et al.; and Considerations for Security in the OSI Architecture, by Branstad; all from *IEEE Network Magazine*, vol. 1, No. 2 (Apr. 1987).

Article: "Communication Theory of Secrecy Systems", by Shannon, *Bell System Technical Journal* (Oct. 1949).

Article: "Digital Transmission in the Presence of Impulsive Noise", by Engel, *Bell System Technical Journal* (Oct. 1965).

Article: "Simultaneous Design in Both Magnitude and Group-Delay of IIR and FIR Filters Based on Multiple Criterion Optimization", by Cortelazzo et al., *IEEE Transactions on Acoustics, Speech, and Signal Processing*, vol. ASSP-32, No. 5 (Oct. 1984).

Article: "On Time Warping and the Random Delay Channel", by Blanco et al., *IEEE Transactions on Information Theory*, vol. IT-25, No. 2 (Mar. 1979).

Article: "Extending the Impulse Response in Order to Reduce Errors Due to Impulse Noise and Signal Fading", by Webb et al., presented at Mobile Satellite Conference, Pasadena, CA (May 1988).

Article: "On the Potential Advantage of a Smearing-Desmearing Filter Technique in Overcoming Impulse-Noise Problems in Data Systems", by Wainwright, *IRE Transactions on Communications Systems* (Dec. 1961).

Article: "Signal Design and Error Rate of an Impulse Noise Channel", by Richter, Jr. et al., *IEEE Transactions on Communication Technology*, vol. COM-10, No. 4 (Aug. 1971).

Article: "Design of Smearing Filters for Data Transmission Systems", by Beenker et al., *IEEE Transactions on Communications*, vol. COM-33, No. 9 (Sep. 1985).

*Primary Examiner*—Bernarr E. Gregory

*Attorney, Agent, or Firm*—Merchant, Gould, Smith, Edell, Welter & Schmidt

[57] ABSTRACT

Method and apparatus for encrypting and subsequently decrypting an analog or digital signal are disclosed. During encryption the signal waveform is transformed by a substantially continuous non-linear complex function of frequency. The transformation is characterized in that the time duration of a transformed impulse signal is substantially increased. Decryption requires transformation of the encrypted signal by substantially the complex inverse of the encryption function. The transformations may vary in time during encryption/decryption of a signal.

37 Claims, 14 Drawing Sheets

SIGNAL ENCRYPTION

The present application is a continuation-in-part of U.S. patent application Ser. No. 07/197,697, filed May 23, 1988 which is a continuation-in-part of U.S. Patent application Ser. No. 07/026,691, filed Mar. 17, 1987, both now abandoned.

FIELD OF THE INVENTION

The present invention relates to encryption, and in particular to a new encryption method and apparatus for encrypting a signal, and to corresponding decryption method and apparatus for decrypting the encrypted signal so reproducing substantially the original signal.

DESCRIPTION OF THE PRIOR ART

Conventional encryption methods use bit substitution for encryption. Typically the digital data to be encrypted is combined with a random or pseudo-random sequence by modula 2 addition. The most commonly used encryption method is the Data Encryption Standard (DES) algorithm. The complexity of this algorithm is defined by a 64-bit word which is broken down into a 56-bit cipher and 8 control bits. When using DES the data is encrypted in its digital form and is sent by conventional means such as by modulation. The encrypted data is, however, easily demodulated and reconverted to digital form for analysis by computer in deciphering the code.

A method for encrypting an analog signal has been disclosed in U.S. Pat. No. 2,411,683 to Guanella in which the frequency band of the analog signal is subdivided into a relatively small number of sub-bands and each of the sub-bands is delayed by a separate time delay. The encrypted signal is subsequently decrypted by sub-dividing the encrypted signal frequency band into a plurality of sub-bands and adding a complementary phase delay to each of the sub-bands. A disadvantage of this method is that the decryption process often does not result in a signal which corresponds sufficiently closely to the original signal. A further disadvantage is that when speech is encrypted the depth of encryption is often not sufficient to prevent recognition of significant portions of the speech.

Bit smearing and desmearing filters have been proposed using a constant group delay with frequency to reduce the effects of impulse noise on transmitted data. Such a system is not suitable for encryption, however, as the constant group delay is easily duplicated. Group delay is defined as the derivative of phase with respect to frequency, as opposed to phase delay which is defined to be phase shift as a function of frequency.

SUMMARY OF THE INVENTION

It is an object of the present invention to provide a method and apparatus for signal encryption and a method and apparatus for corresponding signal decryption.

The impulse response of the encryptor device is chose to scramble the incoming signal which may be in digital or analog form. As a result, the encrypted signal which may also be in digital or analog form, appears noise-like, at least to an unintended cryptanalyst. The encryptor impulse response is greatly extended in time relative to an incoming impulse or signal bit, and preferably has highly irregular random variations in amplitude over its length. The magnitude and phase spectra of the transformation which is applied to the signal are then complicated non-linear functions of frequency. These spectra comprise the transfer function of the encryptor and represent the complex fourier transform of its impulse response. A suitable impulse response for the decryptor device is calculated from that of the encryptor. The respective transfer functions are essentially in complex inverse relationship.

The encryption and decryption processes are conveniently implemented by digital means in which each impulse response is represented by a finite sequence of N numbers as digital words. Typically N ranges from 128 to 4096 although longer and shorter responses are envisaged depending on the degree of security required. The encryptor impulse response defines the encryption "key" and may be varied in time as a particular signal is encrypted, with simultaneous variations of the decryptor key. Encryption and decryption are identical processes using matched keys. An incoming digital signal is convolved with the encryptor or decryptor impulse response. An incoming analog signal is first converted to digital form using standard techniques.

A preferred embodiment of the encryptor/decryptor devices used the circuit of a Finite Impulse Response (FIR) digital filter. Such a filter is normally used for frequency separation, particularly where special characteristics are desired such as constant group delay and sharp frequency cut off. According to the present invention, however, the circuit will not be used as a filter but as an all-pass network with random magnitude and phase responses.

The present invention is an improvement over that of U.S. patent application Ser. No. 07/197,697. The latter specification discloses an encryption system in which the encryptor phase response is specifically chosen and from it the decryptor phase response is calculated. The respective impulse responses are then calculated from the phase responses, both magnitude responses being constant with frequency. In contrast, the present specification discloses an encryption system in which the encryptor impulse response is specifically chosen so that both the encryptor magnitude and phase responses vary with frequency. The difficulty of calculating the decryptor impulse response in such a system has been largely overcome.

BRIEF DESCRIPTION OF THE DRAWINGS

FIGS. 4b and 4c are magnitude and phase response plots comprising part of the complex fourier transform of the IR in FIG. 4a.

FIG. 5a is a plot of the overall IR of an encryptor/decryptor system conditioned according to FIGS. 3a and 4a.

FIGS. 5b and 5c are magnitude and phase response plots for the IR of FIG. 5a.

FIGS. 6b and 6c are magnitude and phase response plots comprising part of the complex fourier transform of the IR in FIG. 6a.

FIG. 6d is a spectrogram of the response to an impulse of an encryptor conditioned according to FIG. 6a.

FIG. 7a plots the IR of a decryptor conditioned to decrypt a signal encrypted according to the encryptor of FIG. 6a.

FIGS. 7b and 7c are magnitude and phase response plots comprising part of the complex fourier transform of the IR in FIG. 7a.

FIG. 8a is a plots of the overall IR of an encryptor/-decryptor system conditioned according to FIGS. 6a and 7a.

FIGS. 8b and 8c are magnitude and phase response plots for the IR of FIG. 8a.

DETAILED DESCRIPTION OF THE PREFERRED EMBODIMENTS

The present encryptor and decryptor devices are readily implemented using FIR digital filters, although they do not necessarily include filtering as part of their normal function. It is helpful, however, in understanding the invention to consider the network of FIG. 1 with reference to FIR digital filters.

Rabiner, L. R., and Gold, B., "Theory and Application of Digital Signal Processing", *PRENTICE HALL*, [1976], describes the operation of FIR digital filters in detail. Extension of this work to cover the case of filters with non-linear phase response is discussed in Cuthbert, L. G., "Optimizing Non-Recursive Digital Filters to Non-Linear Phase Characteristics", *THE RADIO AND ELECTRONIC ENGINEER*, Vol. 44, No. 12, [1974]; Holt, A. G. J., Attikiouzel, J., and Bennett, R., "Interative Technique for Designing Non-recursive Digital Filter Non-Linear Phase Characteristics", *THE RADIO AND ELECTRONIC ENGINEER*, Vol. 46, No. 12 [1976]; and Goldberg, Eli, Kurshan, Robert and Malah, David, "Design of Finite Impulse Response Digital Filters with Non-Linear Phase Response", *IEEE TRANSACTIONS ON ASSP*, Vol. 29, No. 5, [1981].

Figure 2A:
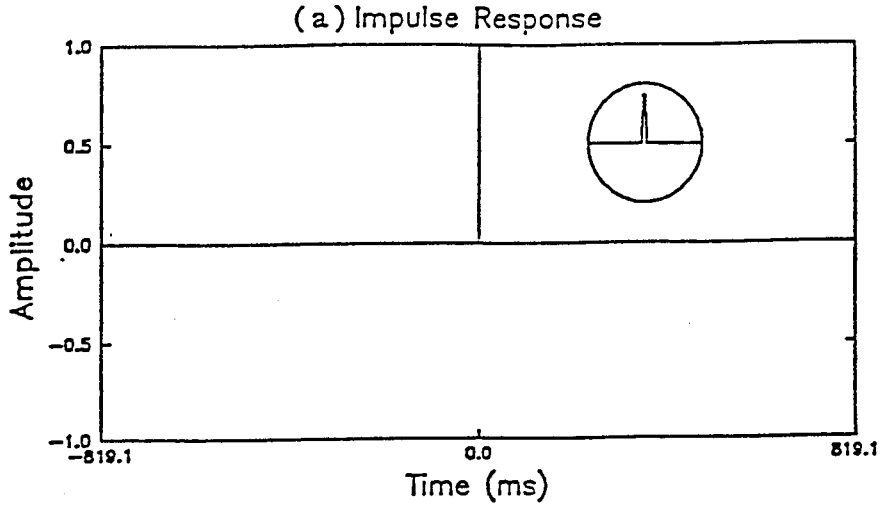
FIGS. 2*a*, 2*b* and 2*c* are respectively the impulse, magnitude and phase responses of a FIR digital all-pass network having zero phase and constant magnitude spectra.
Figure 2B:
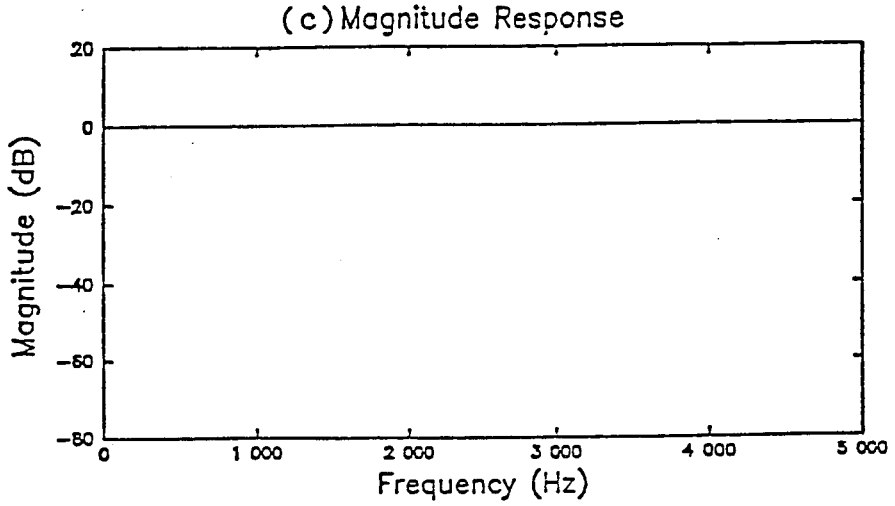
Figure 2C:
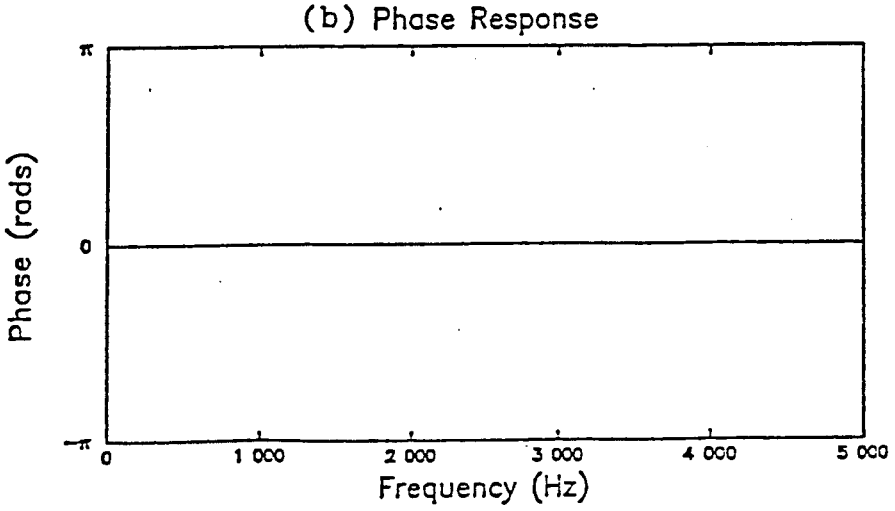

Consider a device with an impulse response as shown in FIG. 2a, corresponding roughly to a typical voice grade transmission channel. The uniform magnitude and phase responses of the device transfer function are shown in FIGS. 2b and 2c respectively, being components of the complex fourier transform of the impulse response. An impulse may be transmitted over such a channel with only slight distortion. Suppose, however, that the impulse response takes the time-extended random form shown in FIG. 3a. Corresponding magnitude and phase responses are shown in FIGS. 3b and 3c. An impulse transmitted over such a channel will be extremely distorted. FIG. 3d shows a spectrogram or voice print for the received transmission, the blizzard-like pattern being typical of random fluctuations or noise. A signal distorted by this channel would be unrecognizable, but provided a corresponding inverse distortion could be applied, the signal content could be retrieved. The present invention provides method and apparatus by which encryption and decryption of a signal may be performed in this fashion. An encryptor and decryptor are readily implemented using FIR digital devices, although other means may conceivably be used.

Figure 1:
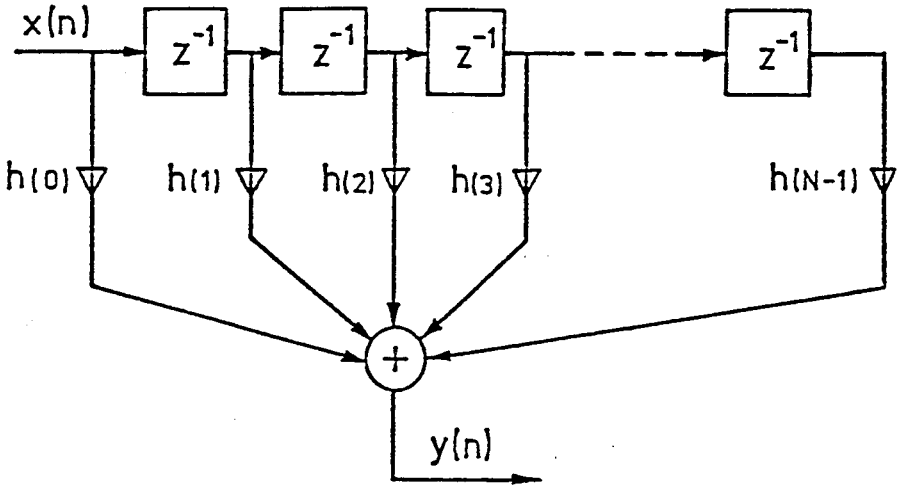
FIG. 1 is a schematic diagram of an N length Finite Impulse Response (FIR) digital network which may be used to implement an encryptor or decryptor according to the present invention.
Figure 3A:
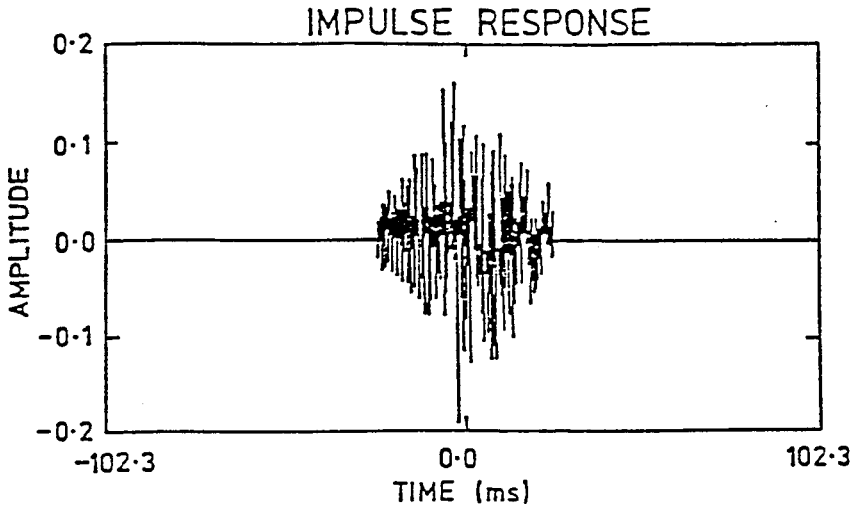
FIG. 3*a* plots a random impulse response (IR) for a 512 length encryptor according to the present invention.
Figure 3B:
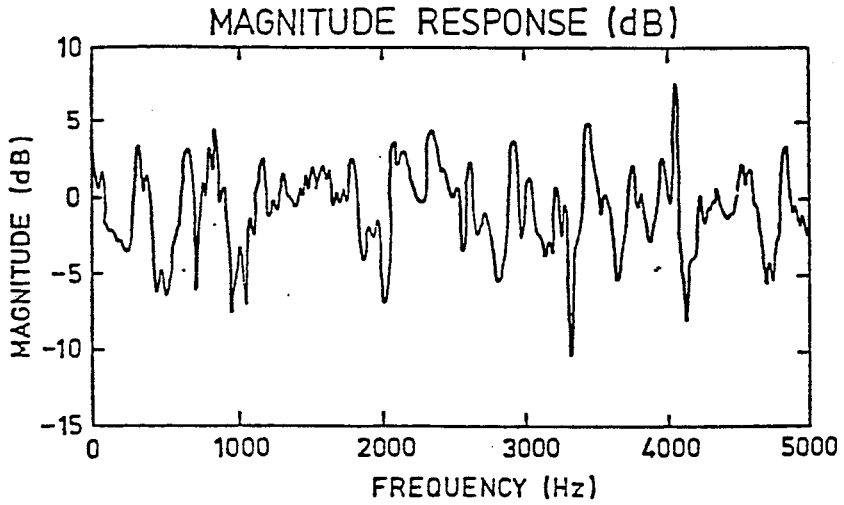
FIG. 3*b* and 3*c* are magnitude and phase response plots comprising part of the complex fourier transform of the IR in FIG. 3*a*.
Figure 3C:
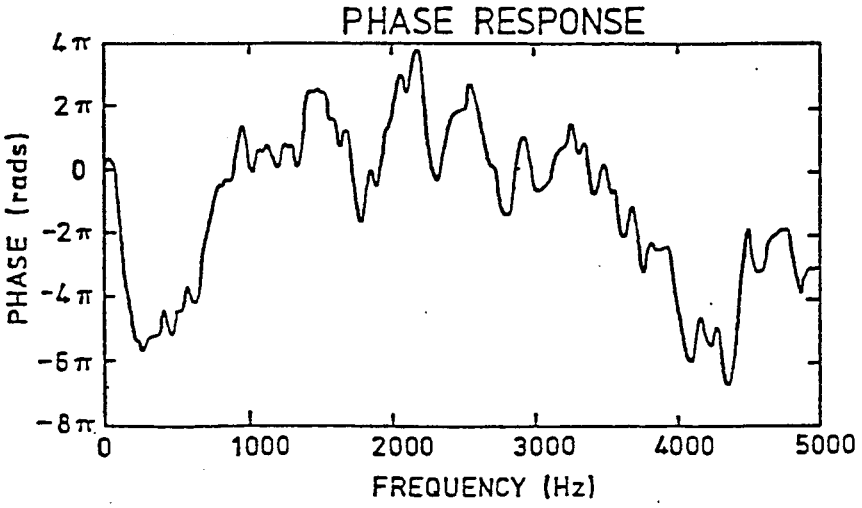
Figure 3D:
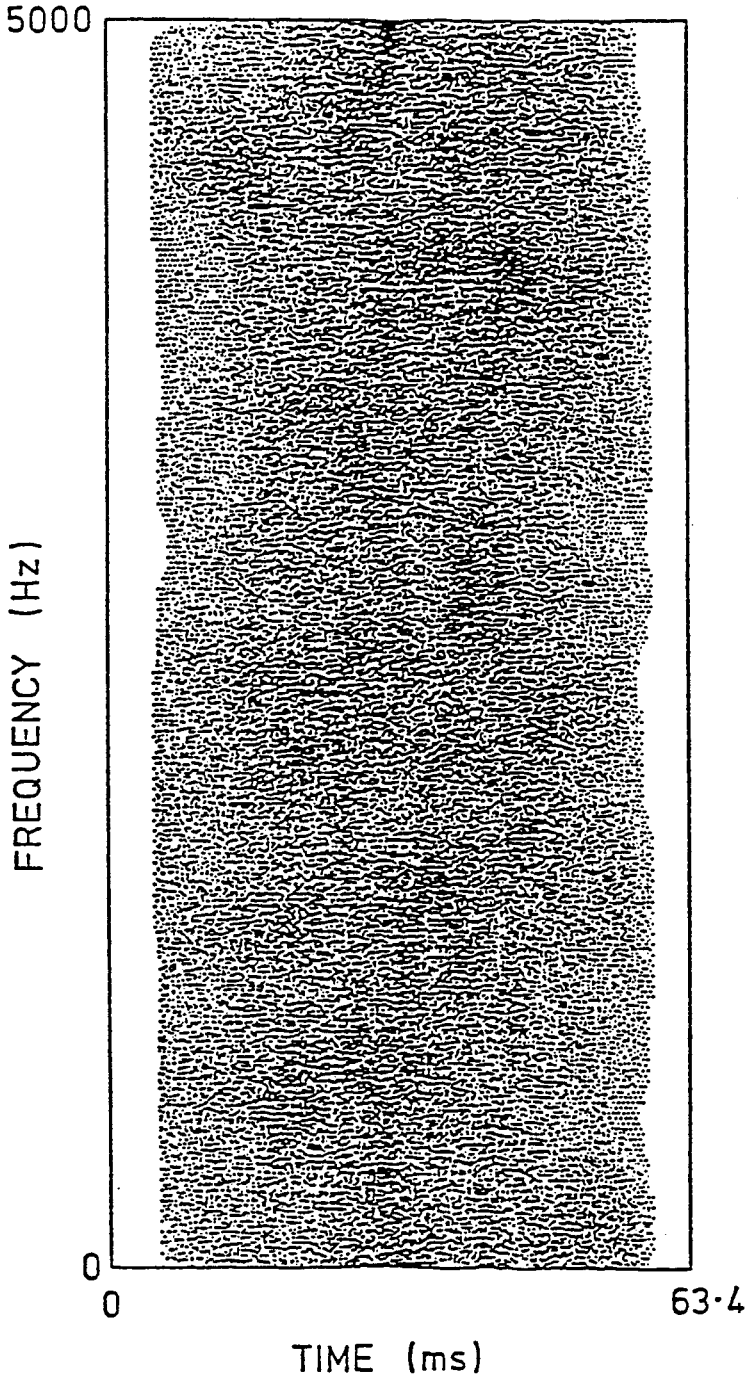
FIG. 3*d* is a spectrogram of the response to an impulse of an encryptor conditioned according to FIG. 3*a*.

The discrete impulse response (IR) of FIG. 3a has 512 terms, and a 512 length FIR network such as shown in FIG. 1 may be conditioned to provide such a response if its h-values are correspondingly set. These h-values provide the "key" controlling the encryption process and, in general, will be randomly chosen. If the resulting encryptor is presented with a series of digital words at some rate (effectively consecutive impulses), the output will consist of the sum of their separate responses staggered by time lags equal to one word length steps. This convolution of the signal and impulse response deliberately creates a high degree to intersymbol interference.

Figure 4A:
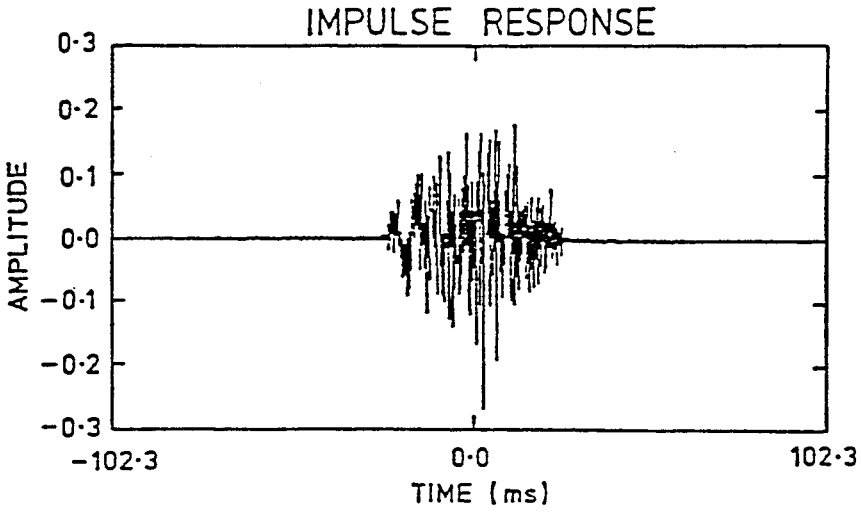
FIG. 4*a* plots the IR for a decryptor conditioned to decrypt a signal encrypted by an encryptor conditioned according to FIG. 3*a*.
Figure 4B:
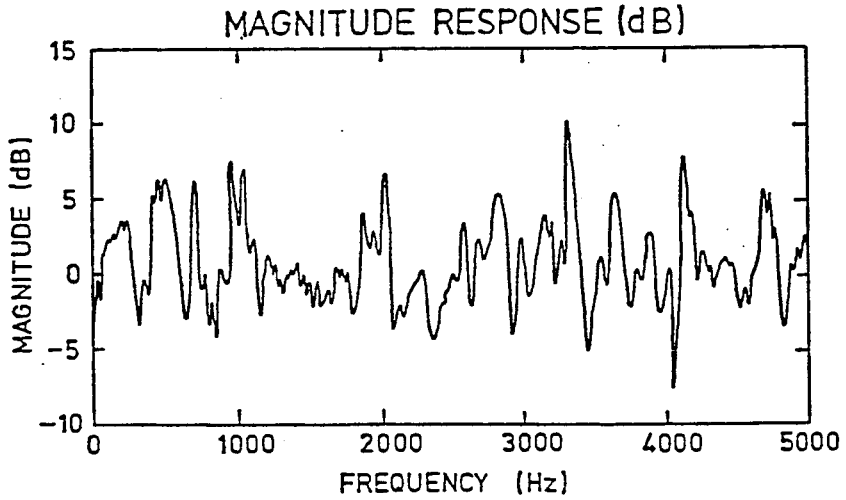
Figure 4C:
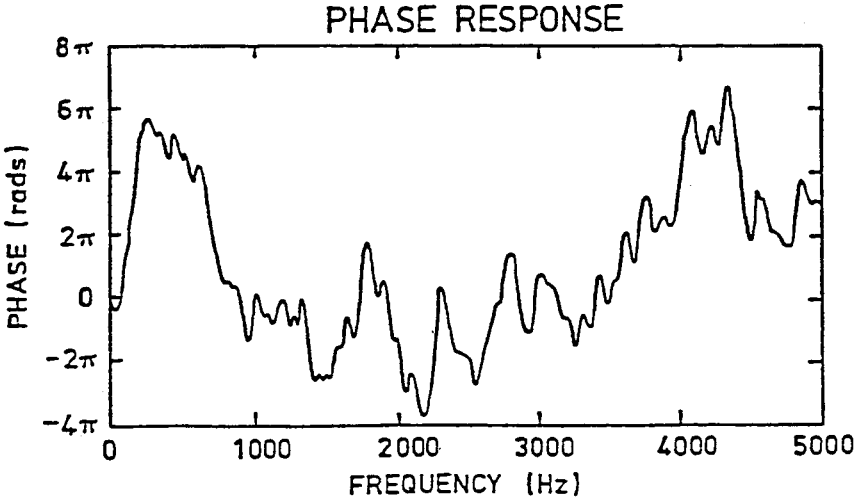
Figure 5A:
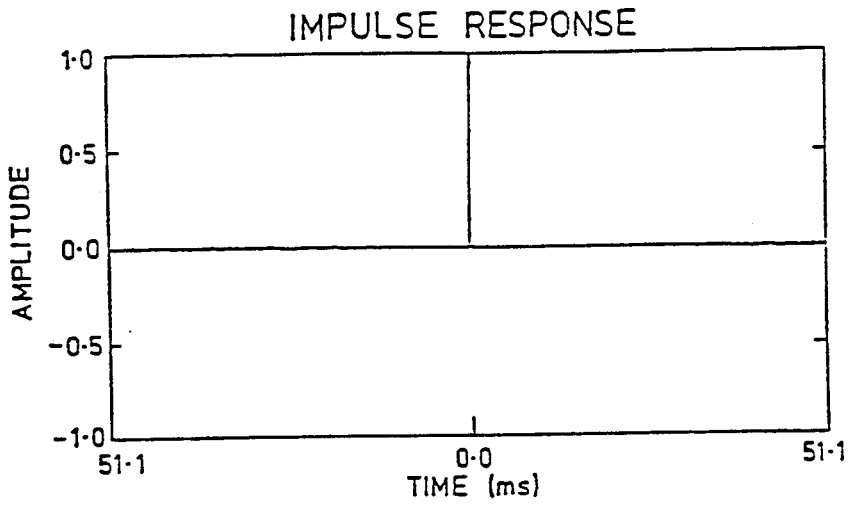
Figure 5B:
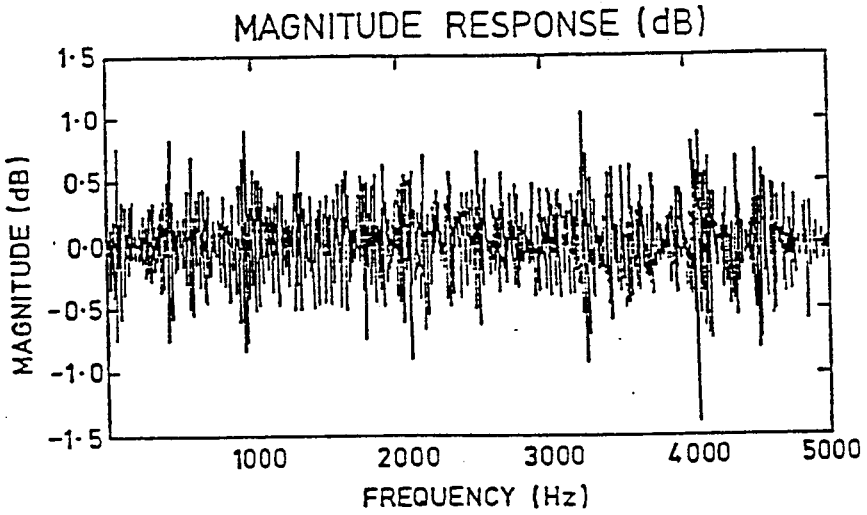
Figure 5C:
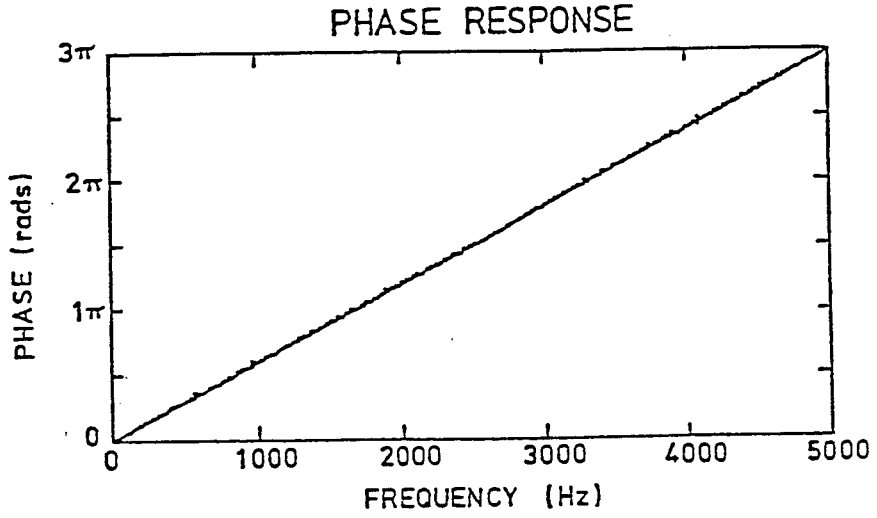

For decryption using a FIR encryptor, a complementary set of h-values are required and these may be obtained by a process which will be described later. A decryptor IR appropriate for an encryptor according to FIG. 3a is shown in FIG. 4a. These two responses may, of course, be interchanged in an encryption/decryption system. The magnitude and phase responses comprising part of the complex fourier transform of the IRs in FIGS. 3a, 4a are shown in FIGS. 3b and 3c, 4b and 4c respectively. FIG. 5a shows the overall IR of an encryption/decryption system in which the IRs of FIGS. 3a and 4a are introduced in series. FIGS. 5b and 5c show the magnitude and phase response of the system which is capable of satisfactorily reproducing the original signal with only a small fixed delay.

FIG. 6 shows the IR of a 128 length encryptor conditioned according to a randomly chosen set of 128 h-values. The corresponding magnitude and phase responses in FIGS. 6b and 6c are seen to be less complicated than those of the 512 length encryptor described above as the IR is reduced to one quarter of its previous duration. The spectrogram of FIG. 6d, while still noise-like, is more regular than that of FIG. 3d. Shortening the length of the encryptor will clearly reduce the security of encryption somewhat but provides improved economy and speed. In encryption of telephone quality voices, the encryptor length must be sufficient to defeat the subtle perception abilities of the human ear. A 4096 length encryptor has been found to provide satisfactory security in this respect.

Figure 6A:
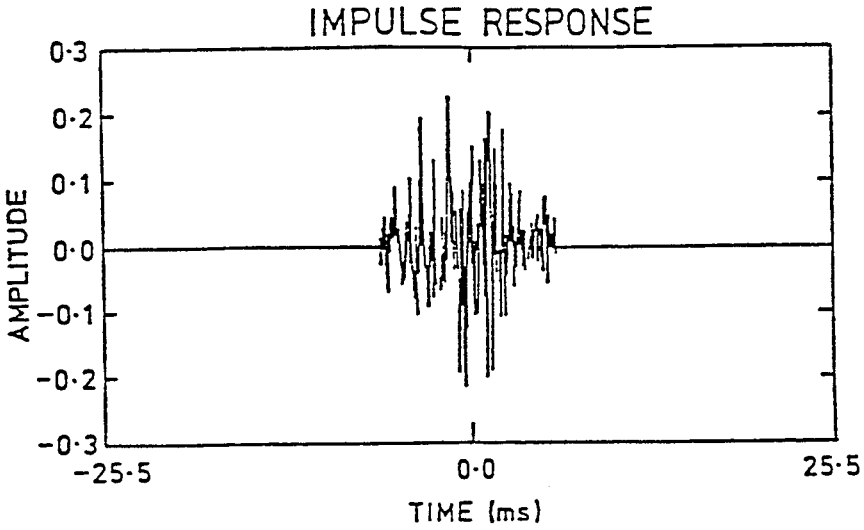
FIG. 6a plots a random IR for a 128 length encryptor according to the present invention.
Figure 6B:
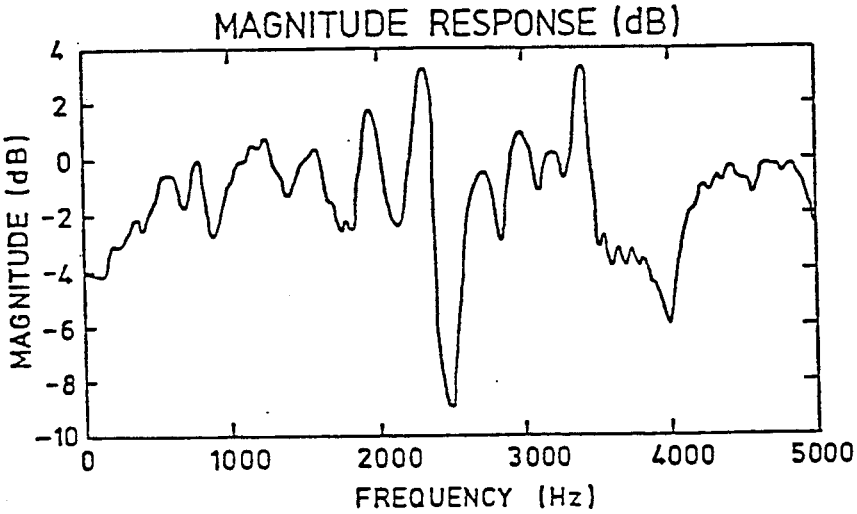
Figure 6C:
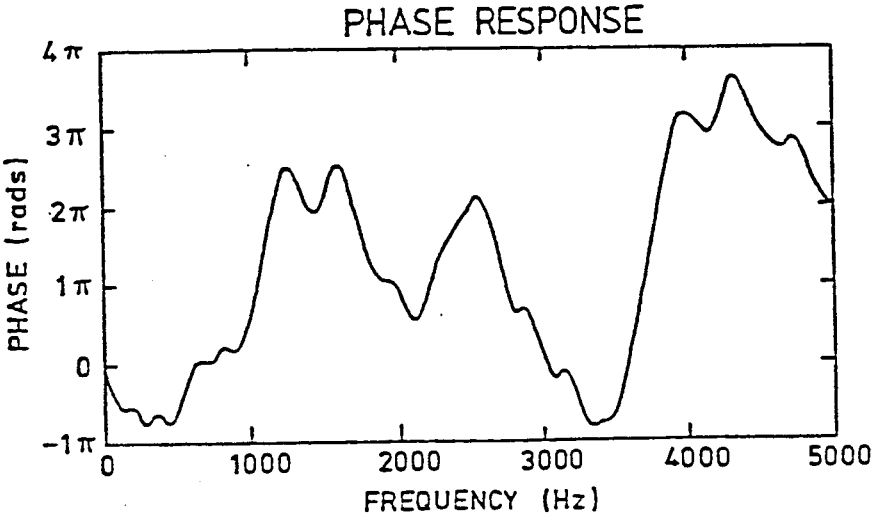
Figure 6D:
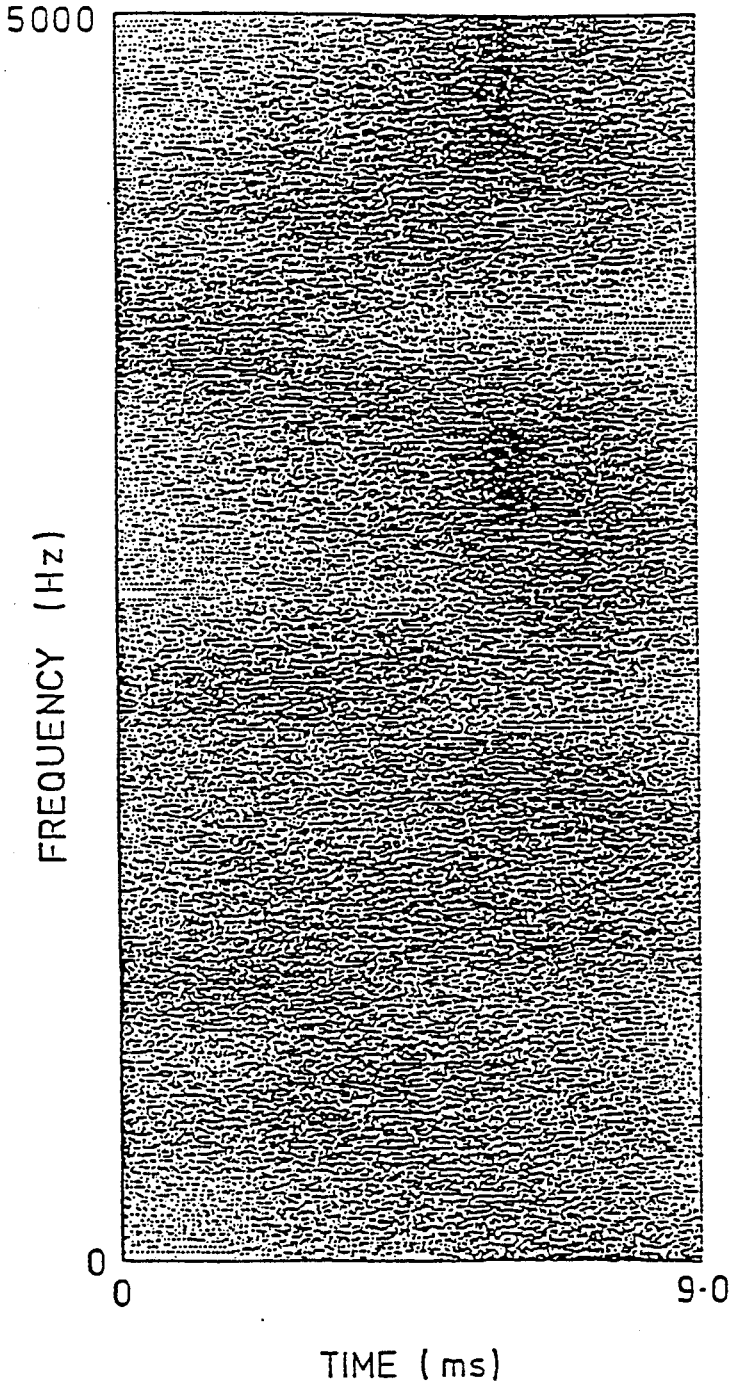
Figure 7A:
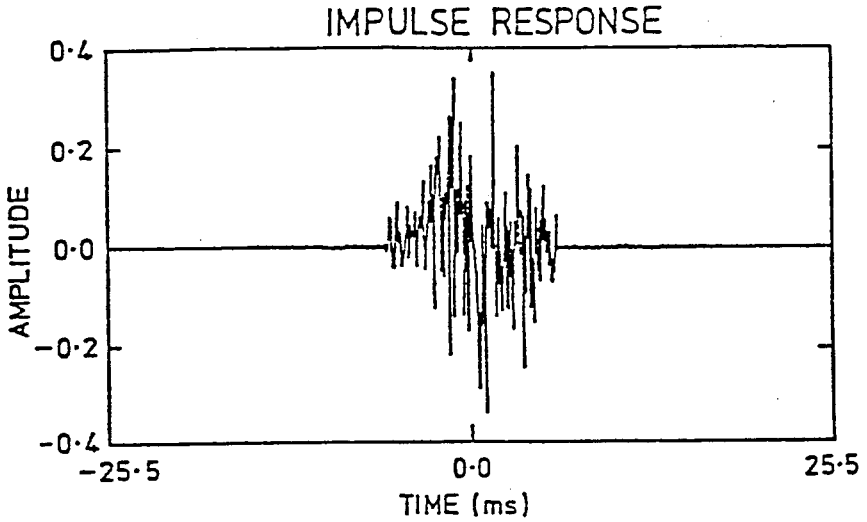
Figure 7B:
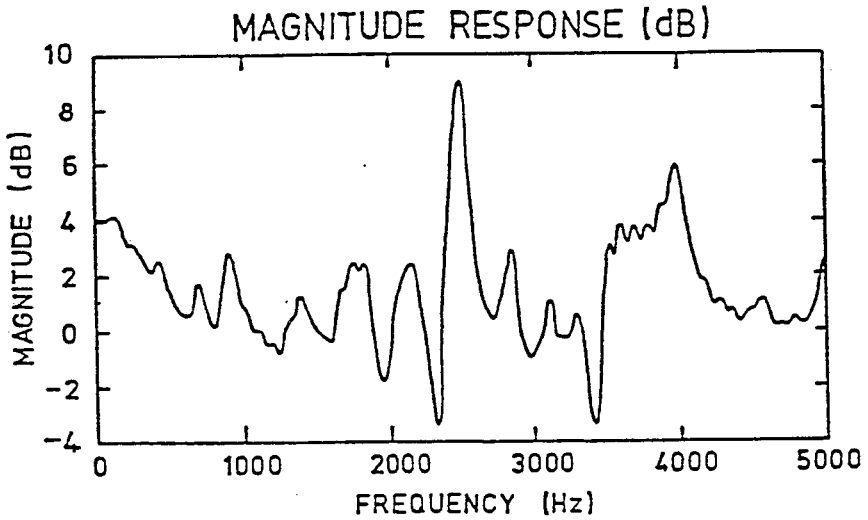
Figure 7C:
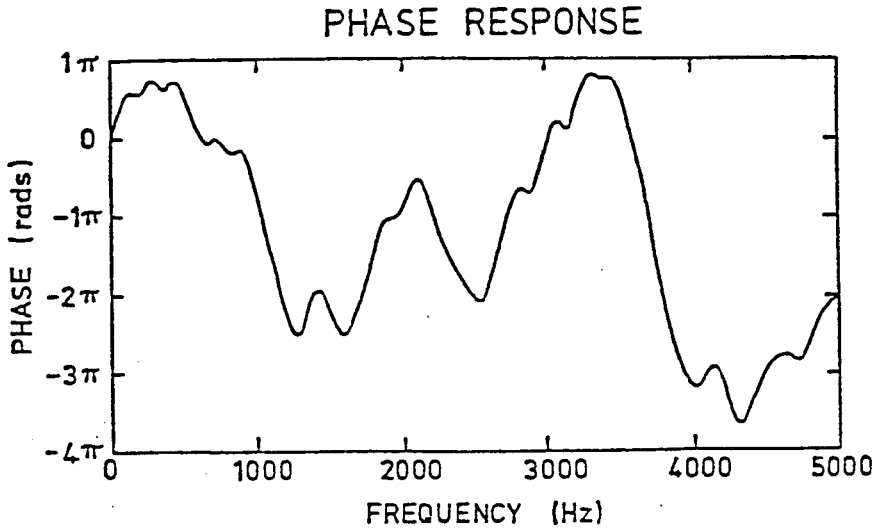
Figure 8A:
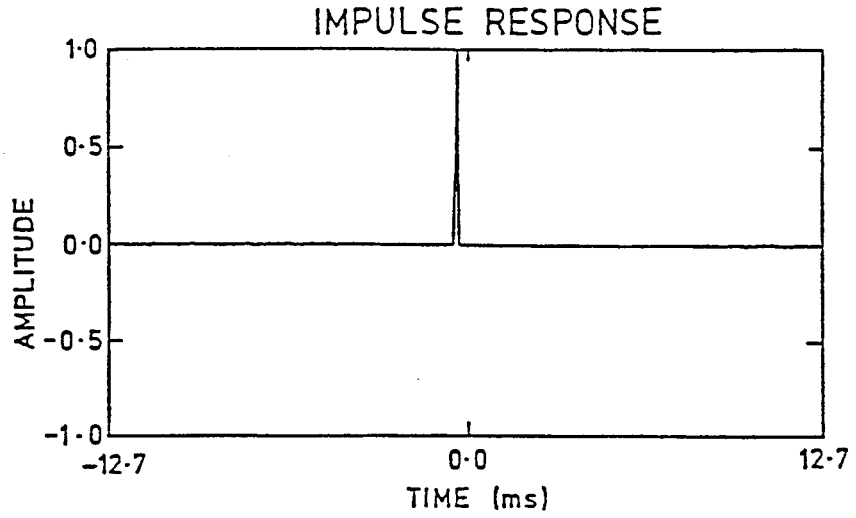
Figure 8B:
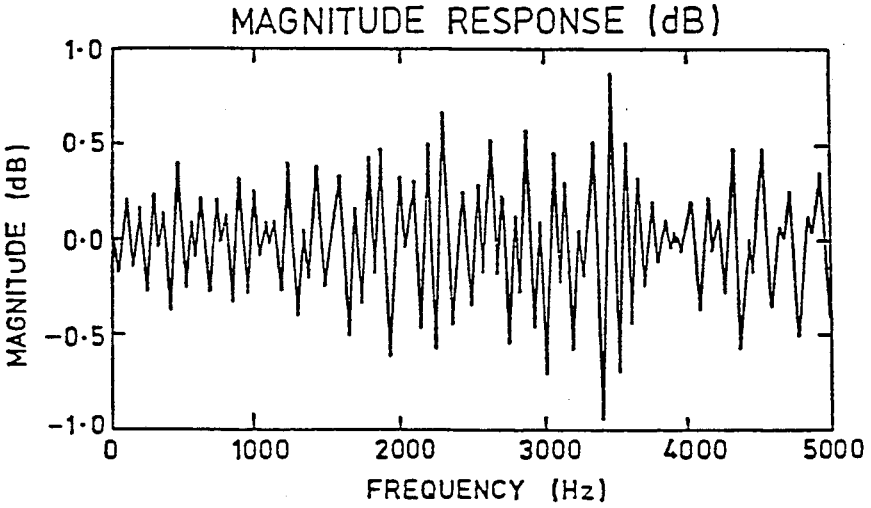
Figure 8C:
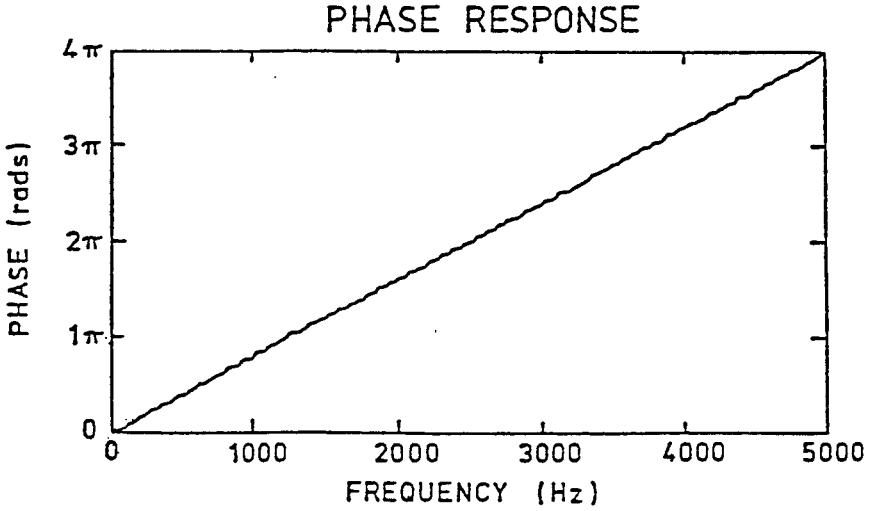

A decryptor IR complementary to that of FIG. 6*a* is shown in FIG. 7*a*. Its magnitude and phase responses are shown in FIGS. 7*b* and 7*c*. The impulse, magnitude and phase responses of the overall encryption channel are shown in FIGS. 8*a*, 8*b* and 8*c*, and show that reproduction of the original signal can be satisfactorily achieved with only a small fixed delay.

Figure 9:
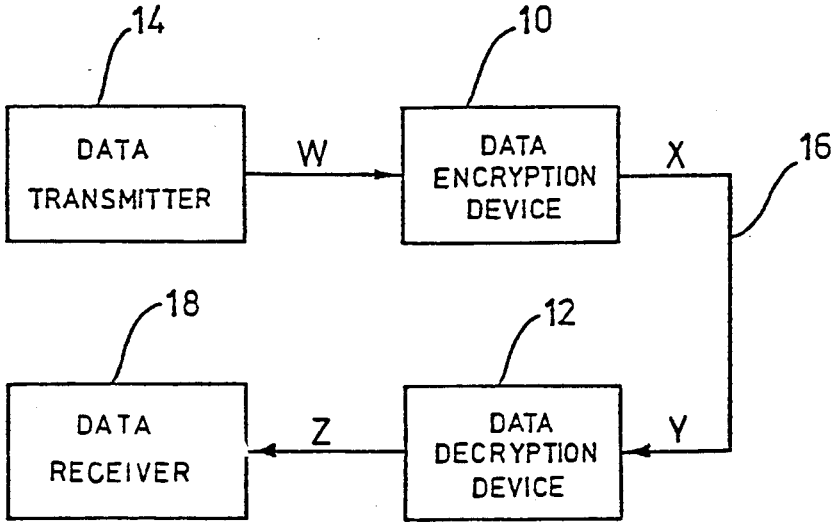
FIG. 9 is a block diagram showing how data encryption and decryption devices according to the present invention may be arranged.

FIG. 9 is a schematic diagram showing how the encryptor IR may be introduced into a data transmission system. The encryptor 10 is placed between the signal source 14 and the data transmission channel 16 so that when the signal is passed to channel 16 it has been scrambled by non-linear magnitude and phase shifts. At the receiving end of channel 16, a decryptor 12 is placed before the receiving equipment 18. The decryptor IR is complementary to that of the encryptor 10 so that the signal is returned to substantially its original form. The net effect of the encryption/decryption process will be a slight delay in the signal transmission time as shown by FIGS. 5*c* and 8*c*.

The nature of the encrypted signal differs from the unencrypted signal, and the influence of channel 16 on transmitted data is changed. For example, a signal may be temporarily disrupted while it is in the channel by sudden fading or a noise spike. This form of disruption to an encrypted signal will be averaged over a longer period of time on decryption because of the length of the decryptor IR, and is less likely to be significant, whereas information would almost certainly be lost from an unencrypted signal.

Figure 10A:
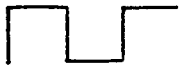
FIGS. 10–10g show typical waveforms at various points in the arrangement of FIG. 9.
Figure 10B:
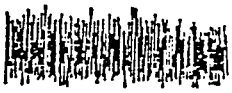
Figure 10C:
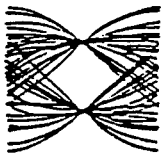
Figure 10D:
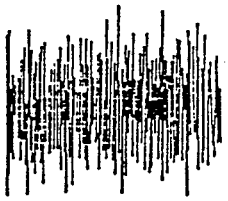
Figure 10E:
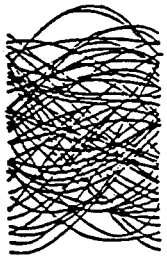
Figure 10F:
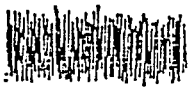
Figure 10G:
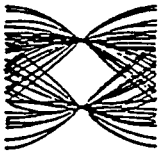

FIGS. 10*a*–10*g* show typical time waveforms at various points in the arrangement of FIG. 9. FIG. 10*b* shows a bandwidth limited binary baseband signal at point W in FIG. 9, derived from the digital sequence represented by FIG. 10*a*. Spreading the signal out in time at point W, synchronizing the signal to the bit rate, and providing multiple traces superimposed upon one another, produces the waveform in FIG. 10*c*, which is known as an open "eye" pattern. Where signals converge at the top level, a binary 1 is detected by sampling. The bottom convergence is detected as a binary 0. The perfect convergence of these traces shows that the signal has zero intersymbol interference. At point X, the waveform has been encrypted to that of FIG. 10*d*. Contrasted with the waveform in FIG. 10*b*, the encrypted data in FIG. 10*d* has higher peaks and looks more like a noise signal. The eye pattern is also changed as shown in FIG. 10*e*, and there is no longer an opening to the eye. At point Y the signal is unchanged from that at point X, assuming that there is no noise on the channel. However, at point Z, after decryption, the signal is restored to be the same as that at point W, as shown in FIG. 10*f*, and the eye pattern is also restored, as shown in FIG. 10*g*.

Figure 11A:
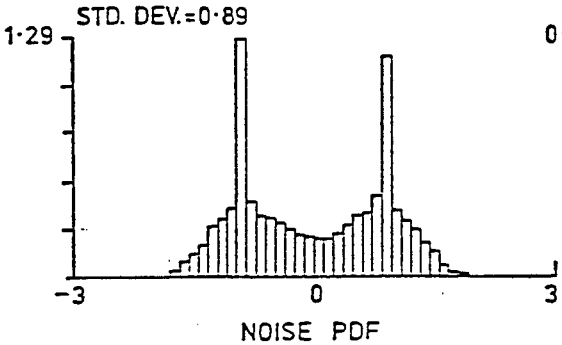
FIGS. 11a and 11b show comparative amplitude probability distributions for binary baseband data, bandwidth limited according to FIGS. 2b and 2c, and passed by an encryptor according to the present invention respectively.
Figure 11B:
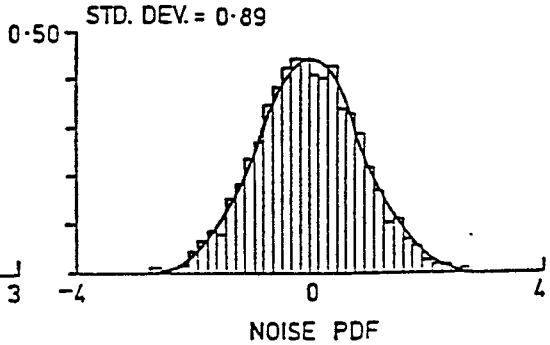

FIG. 11*a* shows the amplitude probability distribution of a baseband binary random sequence, filtered to a bandwidth of B/2, where B is the bit rate, using a filter with an impulse response as shown in FIG. 2*a*. FIG. 11*b* shows the amplitude probability distribution for the same sequence, but the filter responses are now similar to those of one of FIG. 3 to 7. The zero phase filter shows a bimodal distribution around the amplitudes of +1 and −1, whereas the non-linear filter shows a gaussian distribution about 0 amplitude. The non-linear filter produces a signal with greater entropy, and for this reason is a more efficient method of data transmission.

A major advantage of the present method of data encryption is that the bandwidth of the original signal remains unchanged. The signal simply assumes a gaussian random pattern of the same bandwidth. Another advantage is that because the impulse response of the encryptor is greatly extended in time a smearing of the signal takes place over that span of time. As a result, impulse noise and signal fades tend to have much less effect on the final signal after desmearing during encryption.

Figure 12:
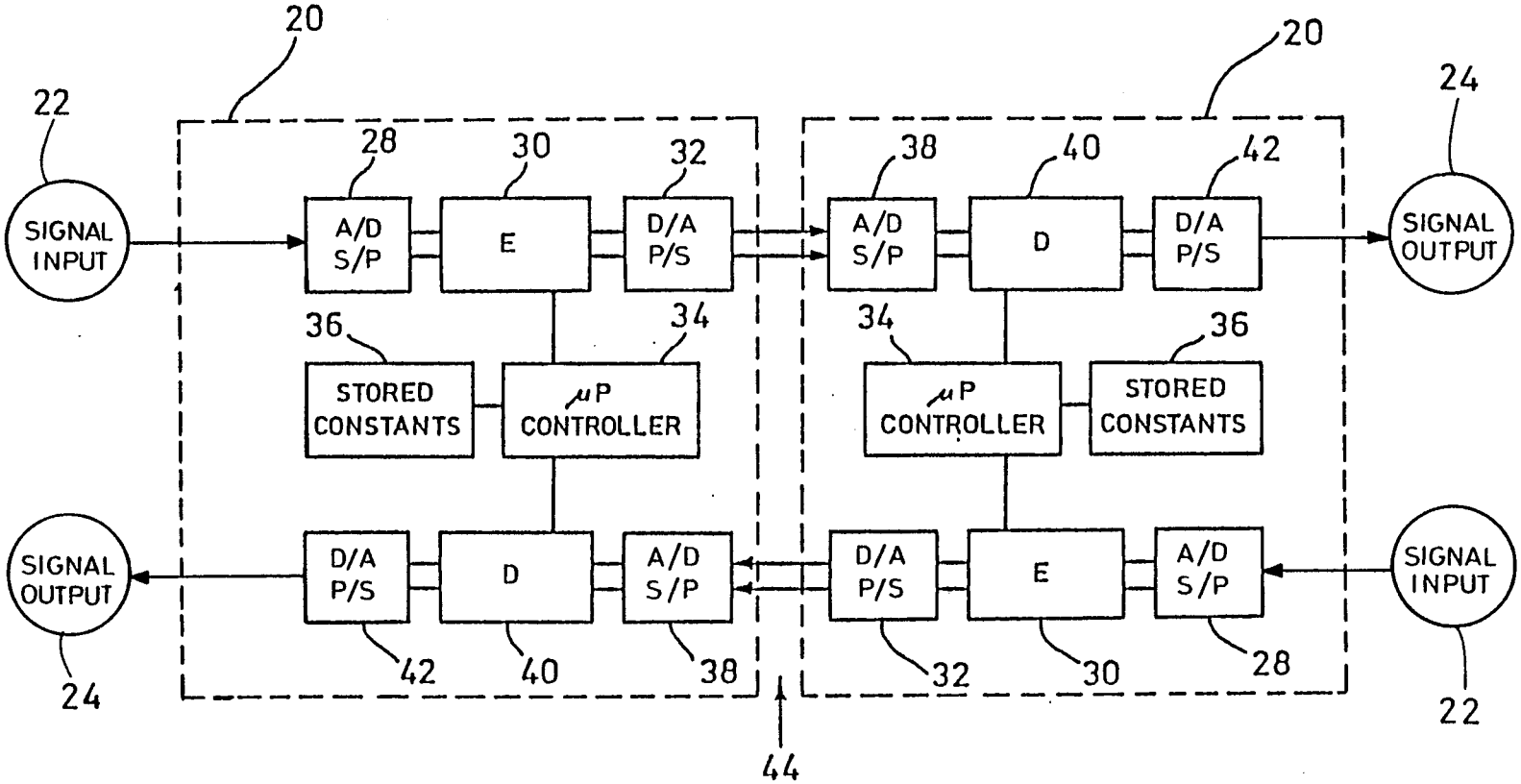
FIG. 12 is a block component diagram of an encryption system employing encryptors and decryptors according to the present invention.

FIG. 12 schematically shows an encryption system for use in a full duplex 4-wire telephone line transmission system. As the system shown is full duplex, there are two transmitter/receiver units 20 shown one on either side of the telephone line 44. The components in each of the units 20 have been given the same reference numerals to indicate that they are identical components.

Signal output 22 and output 24 are typically the microphone and speaker of a telephone handset. The combination of input analog to digital converters (A/D) 28, encryptor 30, output digital to analog converters (D/A) 32, the microprocessor controller 34 and the constants store 36 correspond to the encryption device 10 of FIG. 9.

The four wire line 44 corresponds to two channels 16. A/D 38, decryptor 40, D/A 42, together with the microprocessor controller 34 and the constants store 36 correspond to the decryption device 12. The encryption and decryption devices are under the direct control of their respective microprocessors 34. When the equipment is turned on, the microprocessors 34 load encryption and decryption key values (equivalent to the h-values of a FIR digital filter) into the encryptors 30 and decryptors 40. These constants are stored in some medium such as EPROM, magnetic tape or disc 36.

The above describes a 4-wire telephone line system. In the case of a 2-wire line as would normally be used of an all digital system, the transmission and receiving channels are the same, connected by hybrid to each unit 20 as is well known. A/Ds 28 and 38 become serial-to-parallel converters (S/P) although S/Ps 28 may be unnecessary if the data is already available in parallel form.

Present encryption devices according to the invention satisfactorily use 2048 and 4096 length encryptors, although considerably shorter lengths are envisaged. The keys are stored in EPROMs accessed by a microprocessor-controller. Several separate keys are stored for each of encryption and decryption. Switching keys involves adjusting a dip-switch located inside the device. This design will be described with reference to FIG. 13 and is equally applicable to a decryption device. Complementary devices comprise essentially the same circuitry.

Although the pre-stored method of key control is sufficient at present, it may be necessary in some cases to transmit new keys with which the system will be programmed. Such transmissions may themselves be encrypted by independent means. Ultimately, it may be desirable to enlarge the capabilities of the microprocessor-controller, to give it the capability of calculating keys independently, with the keys being changed by local command, timing or other means.

In a preferred embodiment, the keys to the encryptor and decryptor each consist of 2048 16-bit words while the encryptor input data consists of 13-bit words. Shorter keys may be implemented through software modifications. Short lengths are desirable for increased speed of the system, and in many applications the apparatus hardware may be connected for short lengths only.

Figure 13:
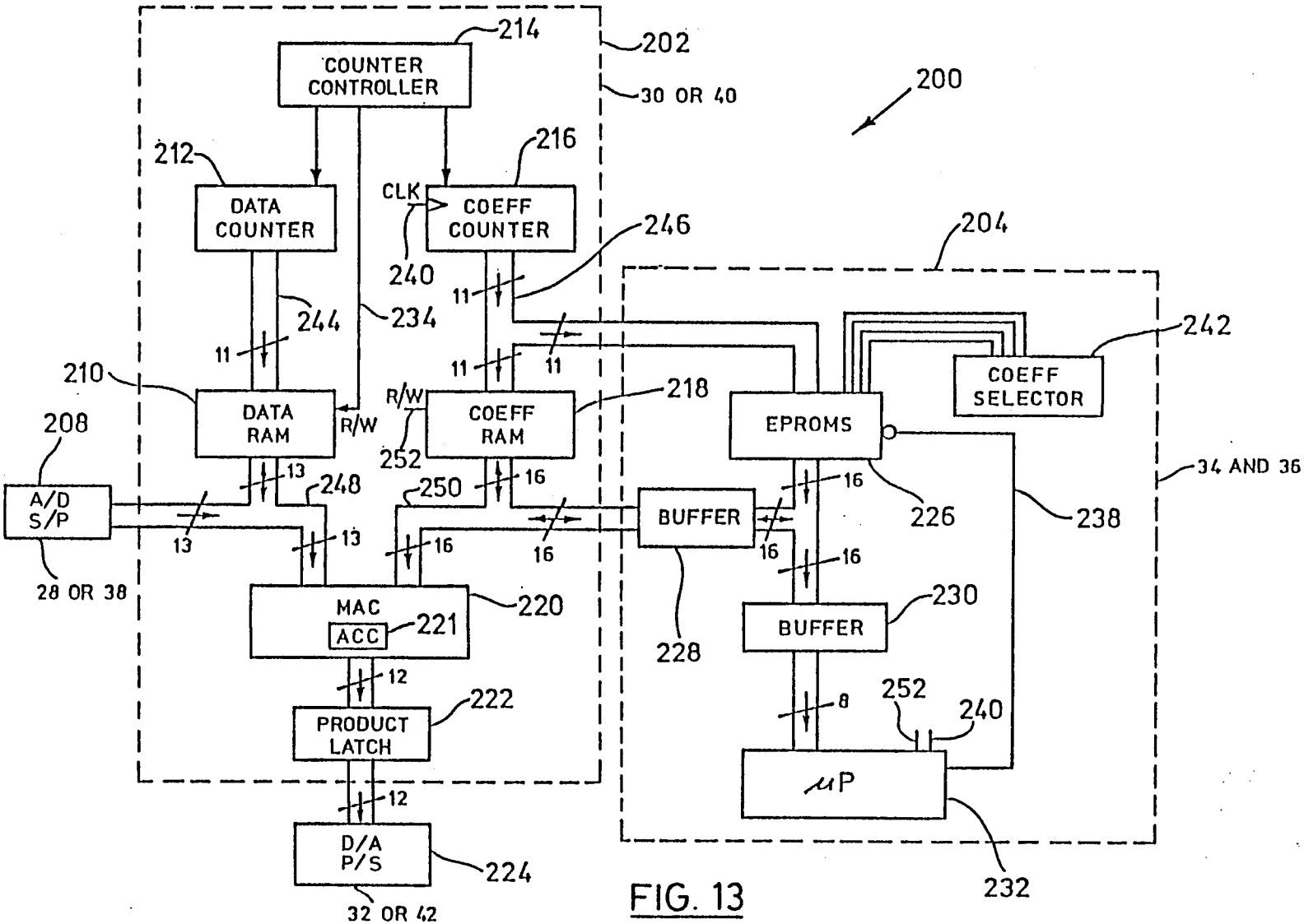
FIG. 13 is a block circuit diagram of encryption or decryption apparatus to be used in the system of FIG. 12.

FIG. 13 lays out schematically a design for the preferred embodiment. An input analog-to-digital or serial-to-parallel converter 28 or 38 converts the incoming signal into discrete samples, say 12 to 14 bit words. These are placed in a delay line formed by DATA ram 210. A static memory, COEFF ram 218 contains the h-values which determine the impulse response. Connected to these two is a multiplier accumulator (MAC) 220. This device 220 takes each sample in the delay line (2048 steps in this case), multiplies each by their respective h-value, adds all together, and finally gives an output sum to the output digital-to-analog or parallel-to-series converters 32 or 42.

At this point a new sample comes from the converter 28 or 38, and the process of addition and accumulation is repeated for another 2048 steps to obtain the second output, and so on. The MAC 220 has to work 2048 times as fast as the converter 28 or 38 and converter 32 or 42.

Operation of Encryptor

When the encryption device is switched on or reset, a set of 2048 h-values (H ) selected by the coefficient selector 242 is transferred to the COEFF ram 218. An initial set of 2048 DATA values ($X_1$) is read into the DATA ram 210 from the input converter 208. These values may be samples of the analog signal to be encrypted. In encryption of an already parallel digital signal, the S/P converters 208 may be dispensed with.

MAC 220 then calculates the product of each of the corresponding pairs ($H_i*X_i$) and accumulates the sum of these products to calculate the value for the encrypted signal (Y). Hence the signal is given by:

$$Y = \sum_{i=0}^{2047} H_i*X_i$$

The next data value X is then read into the DATA ram 210 as $X_0$. Data values $X_0$ to $X_{2046}$ become $X_1$ to $X_{2047}$ and the previous value of $X_{2047}$ is dropped. The value of Y for this new set of data values ($X_i$) is then calculated. Thus, a cycle of 2048 multiplications is performed for each Y-value output.

Circuit Description

The encryption device 200 (FIG. 13) comprises two main blocks, an encryptor block 202 and a coefficient loading block 204. The encryptor block is connected to the output latch of analog-to-digital or serial-to-parallel converter 208 by a 13-bit DATA data bus 248. Counter controller 214 controls the DATA and COEFF counters 212 and 216 are modulo 2048 binary counters, the binary outputs of which are connected to the address inputs of DATA and COEFF rams 210 and 218 respectively. DATA ram 210 contains 2048 13-bit words which may represent samples of an analog input signal or words of an originally digited signal. COEFF ram 218 contains 2048 16-bit words which represent the h-values of the encryptor. The 2's complement representation of integers is used throughout the encryption device.

Multiplier/accumulator (MAC) 220 has two input registers (not shown) one connected to the DATA data bus and the other to the COEFF data bus. The output of MAC 220 is connected to a 12-bit latch 222 which forms the encrypted data output for the encryption device 200. Latch 222 is connected to the digital-to-analog or parallel-to-serial converter 224.

In one embodiment, the MAC 220 is a Waferscale Integration WS59510 or a General Electric Intersil IM29C510 multiplier/accumulator. In both cases, the MAC has a 36-bit internal register for storing the sum of the products Y. The output is configured to give a 12-bit output by taking the 12 most significant bits of value for Y.

Coefficient loading block 204 is used to load a selected set of h-values into the encryptor when the device 200 is switched on or re-initialized. The coefficient loading block 204 is controlled by a microprocessor 232 which has an output line 238 connected to the chip select of EPROM 226. In the prototype, EPROM 226 contains 16 sets of 2048 h-values for the encryptor, although many more sets may be necessary in high security applications of the invention. In the prototype, coefficient selector 242 is a four switch di-switch set to a given position, address bits 0–15 of the EPROM address the 2048 h-values in a selected set.

Microprocessor 232 (FIG. 13) also has control line 240 going to the clock input of COEFF counter 216, and control line 252 going to the read/write input of COEFF ram 218. Bi-directional three-state buffer 228 is used to isolate the coefficient loading block from the encryptor block during each cycle of the device 200 and to allow data transfer, to and from COEFF ram 218, from and to the microprocessor 232 respectively, during coefficient loading. BUFFER 230 is used to transfer the 16-bit COEFF data to an 8-bit port of the microprocessor 232.

Normal Operation

During normal operation of the encryption device 200, DATA ram 210 contains 2048 samples of the input signal and COEFF ram 218 contains the 2048 h-values comprising the encryptor key. The internal accumulator of the MAC 220 is zeroed (i.e. PRODUCT=0) at the beginning of each cycle.

DATA counter 212 and COEFF counter 216 contain initial values $D_0$ and $C_0$ respectively which appear on the DATA address bus 244 and the COEFF address bus 246 respectively. $D_0$ addresses data element $X_0$ in DATA ram 210 and $C_0$ addresses coefficient element HO in COEFF ram 218 causing $X_0$ to appear on DATA data bus and $H_0$ to appear on COEFF data bus 250. MAC 220 reads in the values $X_0$ and $H_0$ calculates their product ($H_0*X_0$) and adds this to the running total PRODUCT stored in the internal accumulator 221 of MAC 220. This completes the 0th step of the one cycle of encryptor 202. As PRODUCT was set to zero before the cycle began, PRODUCT now equals $H_0*X_0$. This process is repeated for 2048 steps.

The next step of encryptor 202 begins and counters 212 and 216 are incremented (modulo 2048) to the values $D_1$ and $C_1$ causing $X_1$ and $H_1$ to appear on the DATA and COEFF data buses respectively. MAC 220 then calculates $H_1*X_0+H_1*X_1$.

In general, during the ith step of encryptor 202, DATA counter 212 contains $D_i$, and COEFF counter 216 contains $C_i$, causing $X_i$ and $H_i$ to be addressed in DATA ram 210 and COEFF ram 218 respectively. $X_i$ and $H_i$ subsequently appear on the DATA and COEFF data buses 248 and 250 respectively. MAC 220 calculates $H_i*X_i$ and adds this to PRODUCT.

At the end of the cycle, i=2047 and PRODUCT is given by:

$$\text{PRODUCT} = \sum_{i=0}^{2047} H_i*X_i$$

PRODUCT is then scaled to give a 12-bit signed integer Y. Y is loaded into product latch 222 which is clocked at an appropriate time to the output converter 224.

After the end of step 2047, DATA counter 212 is incremented by counter controller 214 to the previous value of $D_0$. Counter controller switches read/write line 234 to read. Digital input circuit 208 at this time now has the next DATA value available and this is read into DATA ram 210 at the location addressed by $D_0$. DATA counter 212 is incremented again so that the new value of $D_0$ is the same as the previous value of $D_1$. COEFF counter 216 is also incremented by one to $C_0$ by counter controller 214. This value of $C_0$ is the same as that used previously. Counter controller switches read/write line 234 to write and the internal accumulator 221 of MAC 220 is zeroed. The encryptor is now ready to begin another cycle although ideally, a new key could be loaded at this stage.

Coefficient Loading

When the encryption apparatus 200 is switched on or is reset, microprocessor 232 causes a selected set of 2048 h-values stored in EPROM 226 to be loaded into the COEFF ram 218.

EPROM 226 contains 16 blocks of 2048 16-bit words which are 16 sets of h-values for the encryption apparatus 200. The set of h-values to be used is selected by the coefficient selector 242 which in the prototype is merely a dip-switch with four switches. The four switches are connected to address bits 11-14 of the address input to EPROM 226 so that sixteen different sets of h-values can be stored in the EPROM in consecutive 2048 16-bit word blocks.

Microprocessor 232 zeros COEFF counter 216, switches buffer 228 to allow data transfer from EPROM 226 to COEFF ram 218, sets read/write line 252 to read, switches buffer 230 to allow data transfer from EPROM 226 to the microprocessor 232 and enables EPROM 226 via chip select line 238. The contents of memory location 0 in EPROM 226, which corresponds to $H_0$, are then transferred to memory location 0 in COEFF ram 218 and to the microprocessor 232. The value of $H_0$ is stored by the microprocessor 232 as the first addend in a 16-bit checksum. Counter 216 is then incremented to 1, and memory location 1 in EPROM 216, which corresponds to $H_1$, is transferred to memory location 1 of COEFF ram 218 and added to the check sum in microprocessor 232.

In general, during write step 1, microprocessor 232 increments COEFF counter 216 from 1—1 to 1, and the contents of memory location 1 in EPROM 226, which corresponds to $H_1$, are written into memory location 1 of COEFF ram 218 and added to the checksum in microprocessor 232. The process continues until all 2048 h-values (1-2047) have been read into COEFF ram 218, and the checksum has been completed. Microprocessor 232 then disables EPROM 226 via chip select line 238, sets read/write line 252 to write, and switches buffer 228 to allow data transfer from COEFF ram 218 to microprocessor 232.

COEFF counter 216 is then stepped until all 2048 locations in COEFF ram 218 have been read back into microprocessor 232 and added to form a further checksum. The two checksums are compared and if equal, the encryption device 200 is set in normal running mode. EPROM 226 is then deselected and buffer 228 is disabled. DATA ram 210 is initialized by performing 2048 steps preferably without any Y-values being output. If the checksums are not equal, an LED on the device indicates to the user that a memory fault has been detected. The coefficients may be reloaded with a further memory check, although encryption will not proceed until such memory faults have been cleared. It is preferable that the coefficients of COEFF ram 218 be renewed many times during encryption of a particular signal.

Encryption and decryption devices will operate in the following fashion:

(a) Turn equipment on.

(b) Wait for warm-up and loading of keys.

(c) Equipment is now ready to send and receive.

In one embodiment of the invention, improved encryption security may be provided using the apparatus of FIG. 13 by "rolling" the encryptor through two or more impulse responses during transmission of a signal. This process can be carried out in accordance with a time sequence which is synchronized between the transmitting encryption device and the intended recipient decryption device. The time sequence can provide for linear or random rates of change between various impulse responses. This technique has been simulated by computer and found feasible for encryption of both analog and digital signals.

The coefficient loading circuit 204 remains active during operation of the encryption device and modifies the coefficients used by the encryptor 202 as signal transmission proceeds. The coefficients held in COEFF ram 218 are renewed by microprocessor 232 during encryption. The time sequence controlling the coefficient variation is held in additional memory (not shown in FIG. 13) to which the microprocessor has access. For example, the coefficients may be renewed after each cycle of MAC 220, that is, after each Y value is output to the converter 32 o4 42. The microprocessor 232 must then work at least as fast as MAC 220 which in turn must work 2048× as fast as the converter 28 or 38. The microprocessors of the encryption and decryption devices must clearly be synchronized for proper decryption to occur, and this is easily ensured by transmission of suitable timing signals during startup of an encrypted transmission.

In the rolling process, "fade in" and "fade out" of the preferably random IRs may be performed by considering consecutive IRs to be additive as uncorrelated signals, just as 2 independent noise sources are uncorrelated. That is, because of the random phase relationship between uncorrelated impulse responses, they must be combined during the fading process by power rather than voltage additions.

Figure 14:
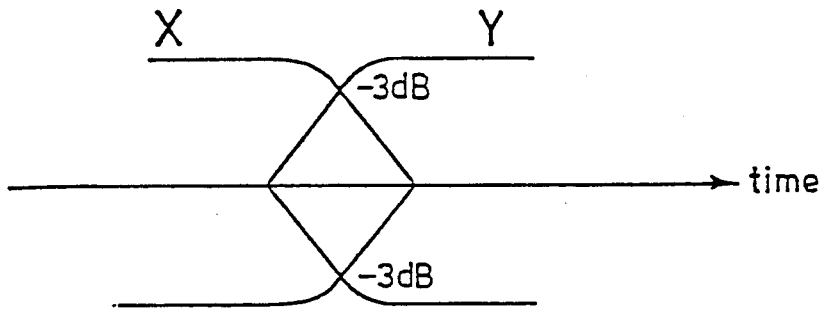
FIG. 14 represents fading in and out of an encryptor/decryptor impulse response.

The spectrum of an impulse response which varies in time is shifted by an amount which depends on the rate of variation. Experimentally, shifts of up to +100 Hz have so far been simulated in transmission over a voice channel and are found to give negligible effect on the quality of the signal. Consecutive IRs are faded in and out of the encryptor and decryptor according to FIG. 14, in which X and Y represent contributions to the signal power generated by the fading in and fading out responses respectively. Their combined power should remain constant during the process, as is evident from the figure. An unintended cryptanalyst will thereby be less likely to be able to determine when and how the variation in encryptor IR is taking place. Also, the rate of variation must be sufficiently slow that the shift in the spectrum of the IR and, therefore, in the spectrum of the transmitted signal remains "small". As mentioned, through computer simulation shifts of up to at least 100 Hz have been found acceptable.

When the phase angles of all components of a signal are shifted by ±90 degrees, the resulting function of time is known as the Hilbert Transform of the signal (see "Communication Systems", S Haykin, Wiley, 1978). Two signals which are related by Hilbert Transform are referred to as a Hilbert Pair. A Hilbert Transform exists for any signal, and any IR, including the random IRs used in the present invention. The Hilbert transform for any of these IRs may be derived using well established software means.

Figure 15:
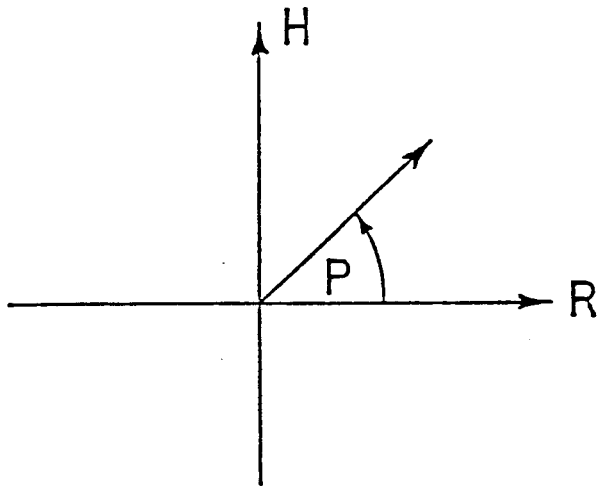
FIG. 15 is a vector diagram demonstrating Hilbert pair impulse responses.

Varying the encryptor IR between each of a Hilbert pair of IRs is analogous to changing the phase of a vector as indicated in FIG. 15. The magnitudes of vectors R and H correspond to the amplitudes of each IR (i.e. particular h-values) of the Hilbert pair. Varying the phase angle P by $\Delta P$ in time interval $\Delta t$, gives a rate of change phase shift $\Delta P/\Delta t$ to the IR, which implies a frequency shift, and the entire spectrum of the signal is shifted up or down by a known amount. Hilbert pairs complementary to those of the encryptor are stored in the decryption device and a corresponding IR variation takes place as signal transmission proceeds. According to FIG. 15, the coefficients of the encryptor IR (and simultaneously the synchronized decryptor IR) may be calculated as $R\cos P+H\sin P$. These coefficients are to be calculated by the microprocessor 232 and installed in the COEFF ram 218 between cycles of the encryptor 202.

The transitional encryptor and decryptor IRs calculated during the variation between known matched, Hilbert pairs of IRs have been found to be sufficiently well matched that acceptable single encryption/decryption takes place during the fading process.

In the above discussion, it was assumed that the two encryptor IRs (and corresponding decryptor IRs) in questions constitute a Hilbert pair, so that the resultant signal is effectively phase shifted in time, in a predetermined manner. This rate of change may be constant with time, so that the vector in FIG. 15 continues to rotate in one direction, causing a positive or negative continuous frequency shift of the signal. Alternatively, the rate of change of phase may be random with time, resulting in a fluctuation in frequency which is both positive and negative with time, depending on the sign of the random time sequence.

Figure 16:
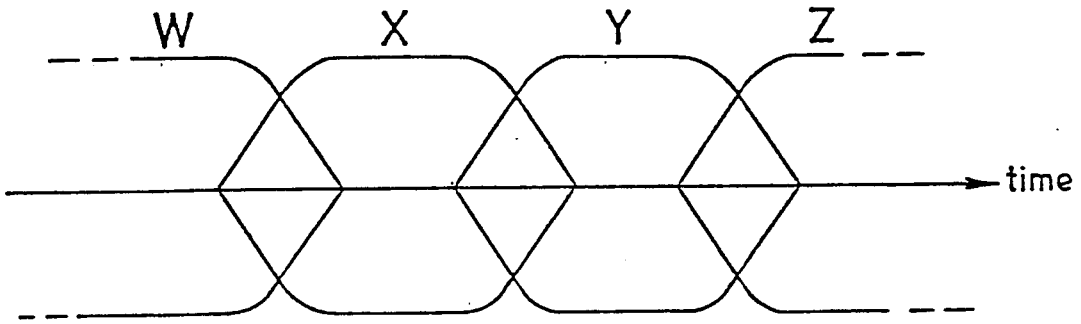
FIG. 16 represents fading in and out of a series of encryptor/decryptor impulse responses according to the present invention.

Recent simulations have indicated that consecutive IRs do not, in fact, have to be components of a Hilbert pair but may be two totally uncorrelated impulse responses. In this case it may be more desirable to perform a simple constant rate of change of IR with time, continuously fading in and fading out through a series of predetermined responses stored in the EPROM 226, as shown in FIG. 16. Returning now to the impulse responses of the encryption and decryption devices. In order to decrypt a signal, a satisfactory "inverse" IR to the proposed encryptor IR must be known. In order to obtain each matching pair of impulse response (i.e. two complementary sets of h-values), a numerical technique is presently employed in which an initial set of h-values are successively modified. According to this technique, the encryptor and decryptor h-values may be determined as follows:

(1) An initial set of h-values is chosen for the encryptor. In the embodiment previously discussed there are 2048 16-bit random numbers in the set, normalized say between +1 and −1. These define an initial highly irregular piecewise IR.

(2) The complex fourier transform of the initial IR is now obtained, in practice by Fast Fourier Transform. The magnitude and phase components of this transform are highly irregular functions of frequency and are normally deliberately truncated, say at the aliasing frequency of the A/D converter of the encryption device. In the embodiment of FIG. 12, which is intended for transmission over a voice grade channel, the A/D sampling frequency is approximately 10 kilohertz and aliasing frequency is, therefore, approximately 5 kilohertz. Modifications of the transform may, of course, vary depending on the form of the transmission channel.

(3) The Fourier transform obtained in step 2 is "inverted". If a point on the transform has magnitude A and phase P, then the corresponding point on the inverse transform is give magnitude 1/A and phase −P. This new complex function is a first approximation to the fourier transform of a possible decryptor IR.

(4) The first approximation IR of the decryptor is obtained by Fast Fourier Transform. Because the amplitude inversion operation of step 3 is non-linear, this first approximation IR is normally longer than that of the encryptor and is truncated to be equal in length. In the prototype, this length consists of 2048 suitably scaled 16-bit h-values.

(5) The two sets of h-values, one for the encryptor and one for the decryptor, must be complementary or matched in order that an encrypted signal can be returned to substantially its original form. Due chiefly to the necessary truncation procedures, the initial and first approximation h-values determined by the above process will not usually be a satisfactory match. A better match may often be obtained by repetition of the above process, the first approximation h-values being substituted for the initial values of step (1). After a sufficient number of repetitions, the initial and final values of the last iteration may provide the impulse responses of a complementary encryptor/decryptor pair. Reducing the length of the encryptor actually reduces the success rate of the matching process. For example, for a 2048 length encryptor, the rejection rate (poor encryptor/decryptor match) after 300 iterations is less than 5% while that for a 128 length encryptor is about 65%.

Alternatives to the iterative process undoubtedly exist, such as Wiener Filtering, and these are presently being investigated. They will allow easier determination of decryptors for shorter length encryptors. The signal delay and cost of an encryptor are proportional to its length and, therefore, shorter length encryptors are preferable, provided sufficient encryption security can be achieved.

Approaching the encryption system from a cryptanalyst's point of view requires a complete reorientation of thinking with regard to that of conventional cryptanalysis. The reason is that now the cryptanalyst no longer has simple random binary numbers to sort out. Rather, he has a complete set of complex binary words representing voltage levels, which have not yet been resolved into random binary numbers. This is because of the closure of the eye pattern. Worse still, with analog transmission of the encrypted signal, he cannot even demodulate the waveform until he has sorted out these complex words.

Using the example of a 2048 length encryptor, with each h-value represented by 16 binary bits, the probability of guessing all bits correctly is one part in $$2^{2048\times 16}$$

which clearly makes the cryptanalyst's task formidable if not impossible.

What is claimed is:

1. A method of transferring information comprising:
encrypting the information by passing it through a first network having a programmable impulse response;
said network impulse response being determined by a set of network constants;
said constants being provided by an encryption key consisting of a first set of pseudo random numbers;
decrypting the encrypted information by passing it through a second network similar to said first network which has as network constants a decryption key consisting of a second set of pseudo random numbers which produce an impulse response for the second network which is complementary to the impulse response of the first network.

2. A method of secure signal transmission comprising:
encrypting the signal by passing it through a first network having a programmable impulse response;
said network impulse being determined by a set of network constants;
said constants being provided by an encryption key consisting of a first set of pseudo random numbers;
passing the encrypted signal through a transmission medium;
decrypting the signal received from the transmission means by passing it through a second network similar to said first network which has as network constants a decryption key consisting of a second set of pseudo random numbers which produce an impulse response for the second network which is complementary to the impulse response of the first network.

3. A method according to claim 2 wherein the transmission medium is a communications channel.

4. A method according to claim 2 wherein the transmission medium is a data bus.

5. A method according to claim 2 wherein the signal is a digital signal.

6. A method according to claim 2 wherein the signal is an analog signal.

7. A method according to claim 6 wherein the analog signal is a voice signal.

8. A method according to claim 2 wherein the network constants are selected to produce constant amplitude response, with a non-linear phase response over the transmission bandwidth.

9. A method according to claim 2 wherein said network constants are chosen to produce phase response and non-linear amplitude response over the transmission bandwidth.

10. A method according to claim 2 wherein the pseudo random numbers making up said first set are changed during encryption of a signal and the pseudo random numbers making up said second set are changed during decryption of the encrypted signal such that the impulse response determined by the changed numbers for the second network is complementary to the impulse response determined by the changed numbers for the first network.

11. A method according to claim 10 wherein there are two available sets of pseudo random numbers for each of the first and second networks; those at the second network being complementary to those at the second network being complementary to those at the first network; and the numbers used at each network are synchronously cycled between complementary pairs during encryption and decryption.

12. A method according to claim 11 wherein the two number sets for the first network and the two number sets for the second network produce impulse responses for their respective networks which are Hilbert pairs.

13. A method according to claim 2 wherein the second set of pseudo random numbers is derived from the first set by:
obtaining the complex Fourier transform of the impulse response for the first network produced by the first set of numbers; deriving the complex inverse of said Fourier transform; and truncating the number of terms in the inverted Fourier transform to the number of members in the first set of numbers to produce said second set of numbers.

14. Apparatus for encrypting a signal comprising:
a network having a programmable impulse response;
said network having an input to which the signal is applied and an output which delivers the encrypted signal;
said network impulse response being determined by a set of constants selected to produce a complex aperiodic impulse response;
first storage means for storing at least one encryption key consisting of set of pseudo random numbers; each number corresponding to a network constant;
and first loading means for loading the network constants with a key from said first storage means.

15. Apparatus according to claim 14 wherein said network is a finite impulse response (FIR) digital filter of the Rabiner and Gold type and the network constants are the h values of the FIR filter.

16. Apparatus according to claim 15 wherein said network is a finite impulse response (FIR) digital filter comprising a digital delay line into which samples of the signal to be encrypted are successively read, a digital memory which holds said set of network constants having cell blocks which each store one constant for each element of said delay line, means for multiplying each sample value stored in each element of the delay line with a corresponding network constant held in said memory, and means for summing each individual product output from the multiplying means, the contents of the summing means forming the output of said network.

17. Apparatus according to claim 16 wherein the network has an input stage an analog-to-digital converter and as an output stage a digital-to-analog converter.

18. Apparatus according to claim 16 wherein the network has an input stage a serial-to-parallel converter and as an output stage a parallel-to-serial converter.

19. Apparatus according to claim 16 wherein the network has an input stage an analog-to-digital converter.

20. Apparatus according to claim 16 wherein the network has an output stage a digital-to-analog converter.

21. Apparatus according to claim 14 wherein at least one encryption key is selected such that the network has constant amplitude response; with a non-linear phase response over the signal bandwidth.

22. Apparatus according to claim 14 wherein at least one encryption key is selected such that the network has constant phase response and non-linear amplitude response over the signal bandwidth.

23. Apparatus according to claim 14 including a controller for said first loading means wherein said first storage means store more than one encryption key and said controller causes said first loading means to load more than one encryption key during encryption of a signal.

24. Apparatus according to claim 14 wherein said network is an all-pass network.

25. Apparatus according to claim 14 wherein said network is a band-pass network having a bandwidth derived from the bandwidth of the signal to be encrypted.

26. Apparatus for decrypting a signal encrypted using the apparatus of claim 14 comprising:

a network having a programmable impulse response;

said network having an input to which the encrypted signal is applied and an output which delivers the decrypted signal;

said network impulse response being determined by a set of constants;

second storage means for storing at least one decryption key consisting of a set of pseudo random numbers; each number corresponding to a network constant and selected to provide an impulse response complementary to that used to encrypt the signal;

and second loading means for loading the network constants with a key from said second storage means.

27. Apparatus according to claim 26 wherein said network is a finite impulse response (FIR) digital filter of the Rabiner and Gold type and the network constants are the h values of the FIR filter.

28. Apparatus according to claim 27 wherein said network is a finite impulse response (FIR) digital filter comprising a digital delay line into which samples of the signal to be encrypted are successively read, a digital memory which holds said set of network constants having cell blocks which each store one constant for each element of said delay line, means for multiplying each sample value stored in each element of the delay line with a corresponding network constant held in said memory, sand means for summing each individual product output from the multiplying means, the contents of the summing means forming the output of said network.

29. Apparatus according to claim 28 wherein the network has as an input stage an analog-to-digital converter and as an output stage a digital-to-analog converter.

30. Apparatus according to claim 28 wherein the network has as an input stage a serial-to-parallel converter and as an output stage a parallel-to-serial converter.

31. Apparatus according to claim 28 wherein the network has as an input stage an analog-to-digital converter.

32. Apparatus according to claim 28 wherein the network has as an output stage a digital-to-analog converter.

33. Apparatus according to claim 26 wherein the decryption key is selected such that the network has constant amplitude response, with a non-linear phase response over the signal bandwidth.

34. Apparatus according to claim 26 wherein said encryption key is selected such that the network has constant phase response and non-linear amplitude response over the signal bandwidth.

35. Apparatus according to claim 26 including a controller for said second loading means wherein said second storage means store more than one decryption key and said controller causes said second loading means to load more than one decryption key during encryption of a signal time-wise synchronously with changes of encryption key during encryption of the signals.

36. Apparatus according to claim 26 wherein said network is an all-pass network.

37. Apparatus according to claim 26 wherein said network is a band-pass network having a bandwidth derived from the desired bandwidth of the signal to be encrypted.

* * * * *

UNITED STATES PATENT AND TRADEMARK OFFICE

CERTIFICATE OF CORRECTION

PATENT NO. : 5,101,432

DATED : March 31, 1992

INVENTOR(S) : Joseph A. Webb

It is certified that error appears in the above-identified patent and that said Letters Patent is hereby corrected as shown below:

On the title page, in the abstract, line 2, delete "Method" and insert --Methods-- therefor.".

In column 2, line 34, delete "patent application" and insert --Patent Application-- therefor.

In column 2, line 61, delete "Fig." and insert --Figs.-- therefor.

In column 3, line 22, delete "plots" and insert --plot-- therefor.

In column 3, line 64, delete "Non-recursive" and insert --Non-Recursive-- therefor.

UNITED STATES PATENT AND TRADEMARK OFFICE

CERTIFICATE OF CORRECTION

PATENT NO. : 5,101,432

DATED : March 31, 1992

INVENTOR(S) : Joseph A. Webb

It is certified that error appears in the above-identified patent and that said Letters Patent is hereby corrected as shown below:

In column 3, line 68, delete "Non-recursive" and insert --Non-Recursive-- therefor.

In column 7, line 31, delete "(H)" and insert --($H_1$)-- therefor.

In column 8, line 4, insert --,-- after the words "(not shown)" therefor.

In column 8, lines 60,61 delete "This process is repeated for 2048 steps." after the words "$H_0$ * $X_0$." therefor.

In column 8, line 66, insert --This process is repeated for 2048 steps.-- after the words "$H_1$ * $X_0$ + $H_1$ * $X_1$." therefor.

In column 10, line 46, insert --,-- after the words "Fig.13)" therefore.

32 or 42-- therefor.

In column 10, line 49, delete "32 04 42" and insert --32 or 42-- therefor.

In column 10, line 67, delete "+" and insert --±-- therefor.

In column 11, line 24, delete "transform" and insert --Transform-- therefor.

UNITED STATES PATENT AND TRADEMARK OFFICE

CERTIFICATE OF CORRECTION

PATENT NO. : 5,101,432

DATED : March 31, 1992

INVENTOR(S) : Joseph Alfred Webb

It is certified that error appears in the above-identified patent and that said Letters Patent is hereby corrected as shown below:

In column 12, line 29, delete "transform" and insert --Transform-- therefor.

In column 11, line 27, delete "pair" and insert --Pair-- therefor.

In column 11, line 30, delete "pair" and insert --Pair-- therefor.

In column 11, line 34, delete "pairs" and insert --Pairs-- therefor.

In column 11, line 46, delete "pairs" and insert --Pairs-- therefor.

In column 11, line 51, delete "questions" and insert --question-- therefor.

In column 11, line 51, delete "pair" and insert --Pair-- therefor.

In column 11, line 63, delete "pair" and insert --Pair-- therefor.

In column 11, line 68, "Returning" should start a new paragraph.

In column 12, line 4, delete "response" and insert --responses-- therefor.

UNITED STATES PATENT AND TRADEMARK OFFICE

CERTIFICATE OF CORRECTION

PATENT NO. : 5,101,432

DATED : March 31, 1992

INVENTOR(S) : Joseph Alfred Webb

It is certified that error appears in the above-identified patent and that said Letters Patent is hereby corrected as shown below:

In column 12, line 34, delete "fourier transform" and insert --Fourier Transform-- therefor.

In column 13, line 19, delete "2 2048X16" and insert --$2^{2048X16}$-- therefor.

In column 13, line 50 (claim 2 ) delete "means" and insert --medium-- therefor.

In column 14, line 4 (claim 9), insert --constant-- after the word "produce" therefor.

In column 14, line 47 (claim 14), insert --a-- after the word "of" therefor.

In column 14, line 54 (claim 15), delete "h values" and insert --h-values-- therefor.

In column 16, line 2 (claim 27), delete "h values" and insert --h-values-- therefor.

UNITED STATES PATENT AND TRADEMARK OFFICE

CERTIFICATE OF CORRECTION

PATENT NO. : 5,101,432
DATED : March 31, 1992
INVENTOR(S) : Joseph A. Webb

It is certified that error appears in the above-indentified patent and that said Letters Patent is hereby corrected as shown below:

Column 16, line 43, (claim 35), delete "signals" and insert--signal--.

Signed and Sealed this

Seventh Day of September, 1993

Bruce Lehman

*Attest:*

BRUCE LEHMAN

*Attesting Officer*

*Commissioner of Patents and Trademarks*